US005102355A

United States Patent [19]

Murphy et al.

[11] Patent Number: 5,102,355

[45] Date of Patent: Apr. 7, 1992

[54] MULTIPLE OUTLET LOCKING RECEPTACLE

[75] Inventors: Glenn L. Murphy, Oxford; Donald L. Meath, Shelton; Russell T. Borona, Seymour, all of Conn.

[73] Assignee: Hubbell Incorporated, Orange, Conn.

[21] Appl. No.: 632,788

[22] Filed: Dec. 24, 1990

[51] Int. Cl.[5] ..... H01R 25/00

[52] U.S. Cl. ..... 439/649; 439/752

[58] Field of Search ..... 439/535, 536, 341, 342, 439/649, 650, 651, 654, 638, 682, 752, 731

[56] References Cited

U.S. PATENT DOCUMENTS

| | | | |
|---|---|---|---|
| 3,083,347 | 3/1963 | Fahey, Jr. | 439/679 |
| 3,566,337 | 2/1971 | Martin | 439/650 |
| 4,583,799 | 4/1986 | Wiley | 339/14 R |
| 4,818,237 | 4/1989 | Weber | 439/693 |
| 4,978,318 | 12/1990 | Wiley et al. | 439/654 |

OTHER PUBLICATIONS

Page 3 of Advertising Brochure Entitled "Studio-Tech" Looking Devices by Bryant.

*Primary Examiner*—David L. Pirlot

*Attorney, Agent, or Firm*—G. H. Telfer; A. Mich, Jr.; M. R. Swartz

[57] ABSTRACT

A multiple outlet locking receptacle has a molded insulating body which includes a housing portion and a mounting flange portion formed integrally therewith. The housing portion has a front face thereon. The receptacle includes multiple groups of internal contact elements disposed in the housing portion of the body rearwardly of the front face thereon. The multiple groups of contact elements define multiple electrical outlets adapted for receiving multiple outlet plugs. Multiple arrays of plug blade receiving apertures are defined in the front face of the receptacle body housing portion. The multiple arrays of apertures are aligned with the multiple groups of internal contact elements and have arcuate configurations for accommodating insertion of the blades of the multiple outlet plugs through the apertures into electrical contact with the internal contact elements and then rotation of the blades relative to the internal contact elements into locking relation therewith.

5 Claims, 12 Drawing Sheets

MULTIPLE OUTLET LOCKING RECEPTACLE

CROSS REFERENCE TO RELATED APPLICATIONS

Reference is hereby made to the following applications dealing with related subject matter and assigned to the assignee of the present invention:

(1) "Multiple Outlet Receptacle And Mountings Therefor" by Wiley et al, assigned U.S. Ser. No. 340,198 and filed Apr. 19, 1989, now U.S. Pat. No. 4,978,318, issued Dec. 18, 1990.

(2) "Multiple Outlet Receptacle With Surge Suppression" by Misencik et al, assigned U.S. Ser. No. 495,787 and filed March 22, 1990.

BACKGROUND OF THE INVENTION

1. Field of the Invention

The present invention relates generally to electrical wiring devices and, more particularly, is concerned with a multiple outlet locking receptacle.

2. Description of the Prior Art

A multiple outlet receptacle, such as disclosed in U.S. Pat. No. 4,583,799 to Wiley and assigned to the assignee of the present invention, has four outlets to permit four electrical appliances to be plugged in at one receptacle location. The receptacle may be used, for example, for office lighting applications where it would normally be installed in a ceiling recess fixture, such as an outlet box or concrete ring, or some other surface mounting. The receptacle is designed to have a shallow body of molded insulating material with an integral mounting flange at the rear edges of the body. Internal contact elements of the four outlets are located within respective quadrants of the housing portion of the body. A front face of the housing portion has four sets of plug blade receiving apertures for communicating with the internal contact elements of the four outlets. A rear closing plate of insulating material is configured to fit within the back edge of the housing portion substantially flush with the mounting flange and provides a substantially planar rear surface for the entire unit.

In the exemplary receptacle of the Wiley patent, first and second conductive plates are provided that rest within the housing portion of the receptacle body. The first conductive plate is configured as a ring and is located near the periphery of the unit while the second conductive plate is configured to fit within the first plate and can be made from the same piece of starting material as the first plate. The first and second plates respectively support first and second groups of internal contact elements for the corresponding four outlets. The first and second groups of internal contact elements extend forwardly and are aligned with corresponding arrays of plug apertures in the front face. For a grounding receptacle, a third conductive plate is provided, being located on the outside rear surface of the rear closing plate. The third conductive plate supports a third group of internal contact elements for the corresponding four outlets. The third group of internal contact elements extend through apertures in the closing plate.

The multiple outlet receptacle of the aforementioned patent has been successful in providing a compact, reliable, attractive, and easy-to-use unit, particularly in a surface mounting arrangement. This multiple outlet receptacle has been further improved by the incorporation of the features disclosed in the patent applications cross-referenced above. However, it has been perceived by the inventor herein that, with respect to the above-described multiple outlet receptacle, a need still exists for additional improvement in order to expand its application to use in abusive environments.

SUMMARY OF THE INVENTION

The present invention provides a multiple outlet locking receptacle designed to satisfy the aforementioned needs. The locking receptacle of the present invention incorporates features which provide for security of installed electrical connections. This is desirable in laboratories and hospitals, as well as in the abusive environments of many other diverse industrial and commercial applications.

Accordingly, the present invention is directed to a multiple outlet locking receptacle which comprises: (a) a molded insulating body including a housing portion and a mounting flange portion formed integrally therewith with the housing portion having a front face; (b) multiple groups of internal contact elements disposed in the housing portion of the body rearwardly of the front face thereon and defining multiple electrical outlets adapted for receiving multiple outlet plugs; and (c) means defining multiple arrays of plug blade receiving apertures in the front face of the housing portion, the multiple arrays of apertures being aligned with the multiple groups of internal contact elements and having arcuate configurations for accommodating insertion of the blades of the multiple outlet plugs through the apertures into electrical contact with the internal contact elements and then rotation of the blades relative to the internal contact elements into locking relation with at least one of the contact elements and the housing portion.

The multiple outlet locking receptacle also comprises multiple wall structures on a rear side of the front face of the housing portion for defining physical separation barriers between individual blade-receiving apertures of each of the arrays of apertures and the contact elements of each of the groups of contact elements aligned therewith. Each wall structure has a central cylindrical portion and a plurality of spoke portions rigidly attached to the central portion and extending radially therefrom for providing the physical separation barriers.

Further, the multiple outlet locking receptacle comprises first and second conductive plates disposed within the housing portion and fitted respectively outside and inside of the wall structures and supporting first and second groups of the multiple groups of contact elements. The first conductive plate is an outer conductive plate being configured as an annular ring and located near the periphery of the housing portion. The second conductive plate is an inner conductive plate being configured as a central disk and fitted within the outer ring plate. The locking receptacle also includes an insulating rear plate attached on the housing portion and together with the wall structures completing physical separation of individual contact elements of the first and second groups of contact elements from each other.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
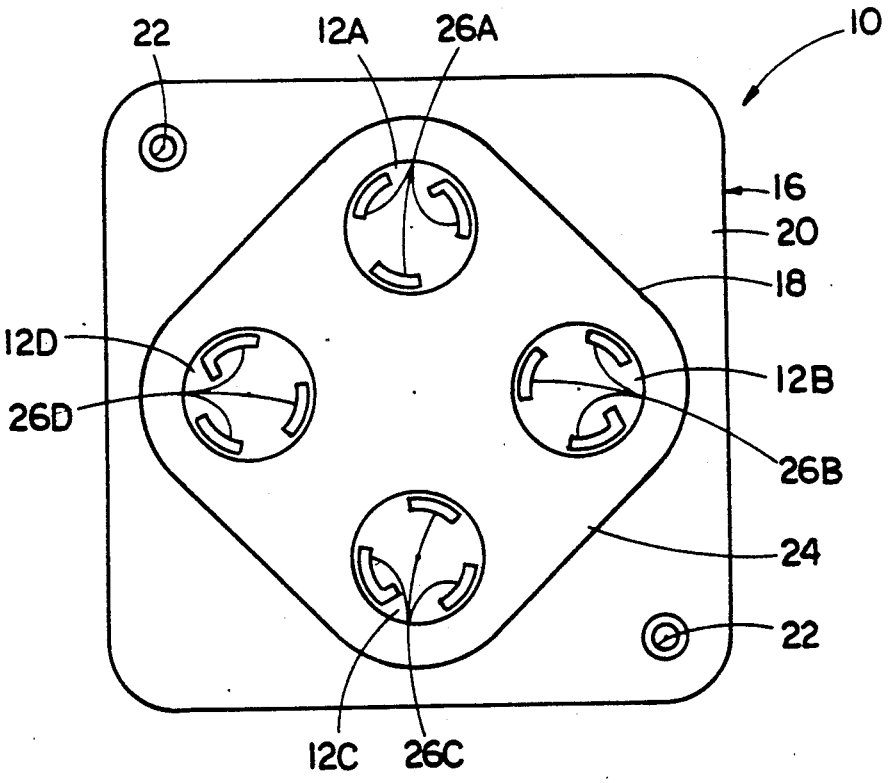
FIG. 1 is a front view of a multiple outlet locking receptacle of the present invention.

In the following description, like reference characters designate like or corresponding parts throughout the several views of the drawings. Also in the following description, it is to be understood that such terms as "forward", "rearward", "left", "right", "upwardly", "downwardly", and the like, are words of convenience and are not to be construed as limiting terms.

Figure 2:
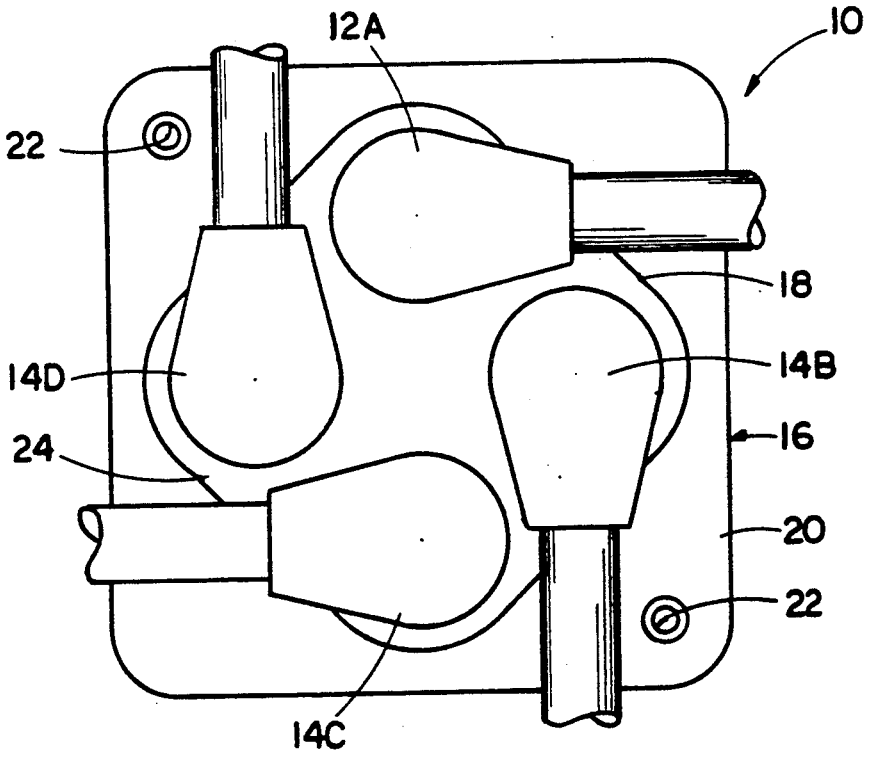
FIG. 2 is a front view of the multiple outlet locking receptacle of FIG. 1 with the plugs in place.

Referring now to the drawings, and particularly to FIGS. 1–3 and 19, there is shown a multiple outlet locking receptacle of the present invention, generally designated 10. In the illustrated embodiment, the locking receptacle 10 has four outlets 12A, 12B, 12C, 12D, with one outlet arranged in each of four quadrants of the receptacle. Although four outlets are illustrated, outlets in other numerical arrangements can be provided. FIG. 2 illustrates the locking receptacle 10 with four plugs 14A, 14B, 14C, 14D installed in the four outlets 12A, 12B, 12C, 12D.

The locking receptacle 10 has a shallow molded insulating body 16 composed of a front housing portion 18 and a rear mounting flange portion 20 integrally formed on and extending radially outward from the rear periphery of the front housing portion 18. The rear mounting flange portion 20 has a plurality of fastener-receiving apertures 22 for mounting the receptacle 10 to an outlet box (not shown). The front housing portion 18 has a front face 24 located forwardly of the rear flange portion 20 so that when the locking receptacle 10 is mounted in an outlet box the housing portion 18 extends forwardly rather than rearwardly from the flange portion 20 within the box.

The front face 24 has multiple arrays of plug blade-receiving apertures 26A, 26B, 26C, 26D defined through it. The number of arrays of apertures 26A, 26B, 26C, 26D correspond to the number of multiple outlets 12A, 12B, 12C, 12D. The apertures 26A, 26B, 26C, 26D are of arcuate shapes for accommodating the insertion and locking rotation of the blades 28 (see FIGS. 22 and 23) of the multiple plugs 14A, 14B, 14C, 14D in the respective multiple outlets 12A, 12B, 12C, 12D.

Figure 3:
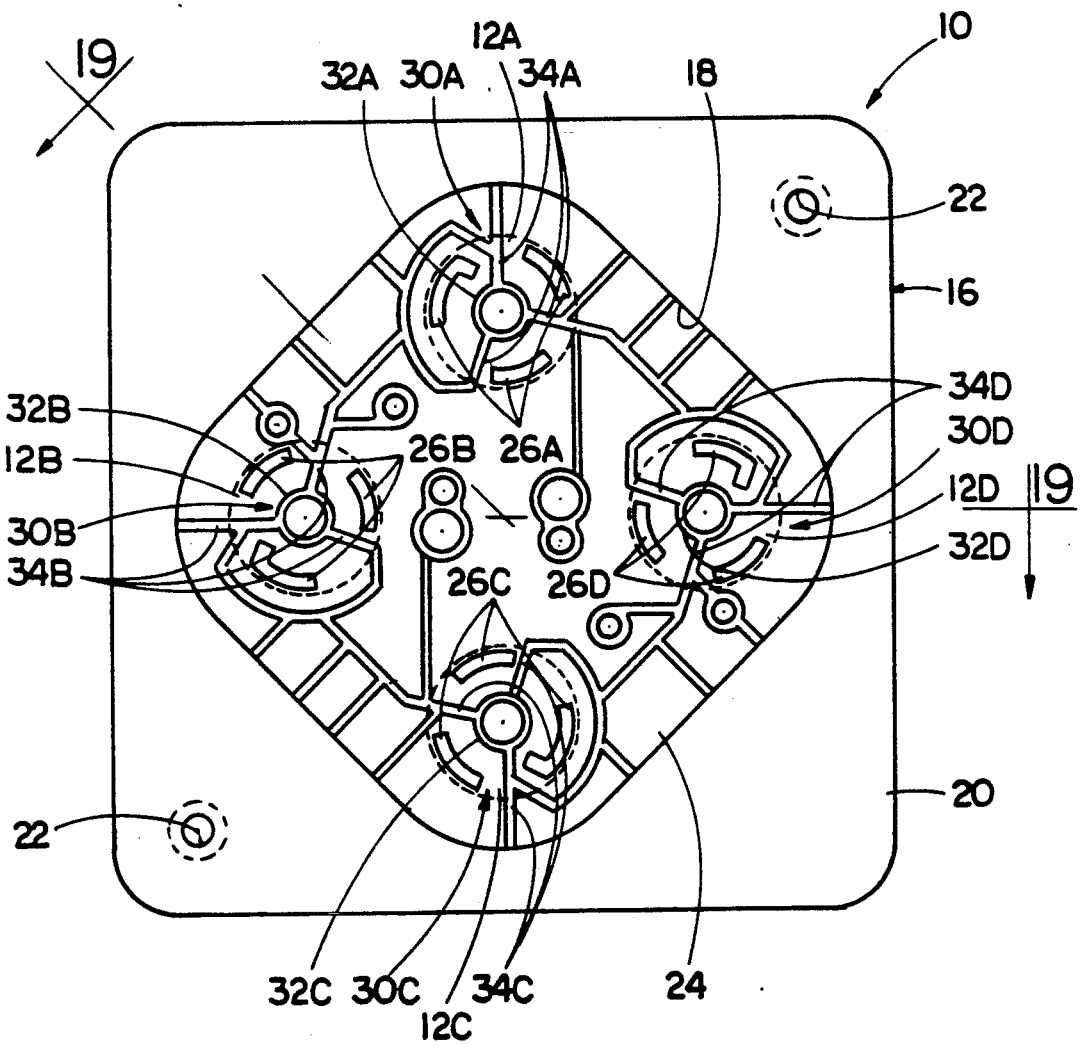
FIG. 3 is a rear view of the multiple outlet locking receptacle of FIG. 1 with contact supporting conductive plates and a rear closing plate removed.
Figure 4:
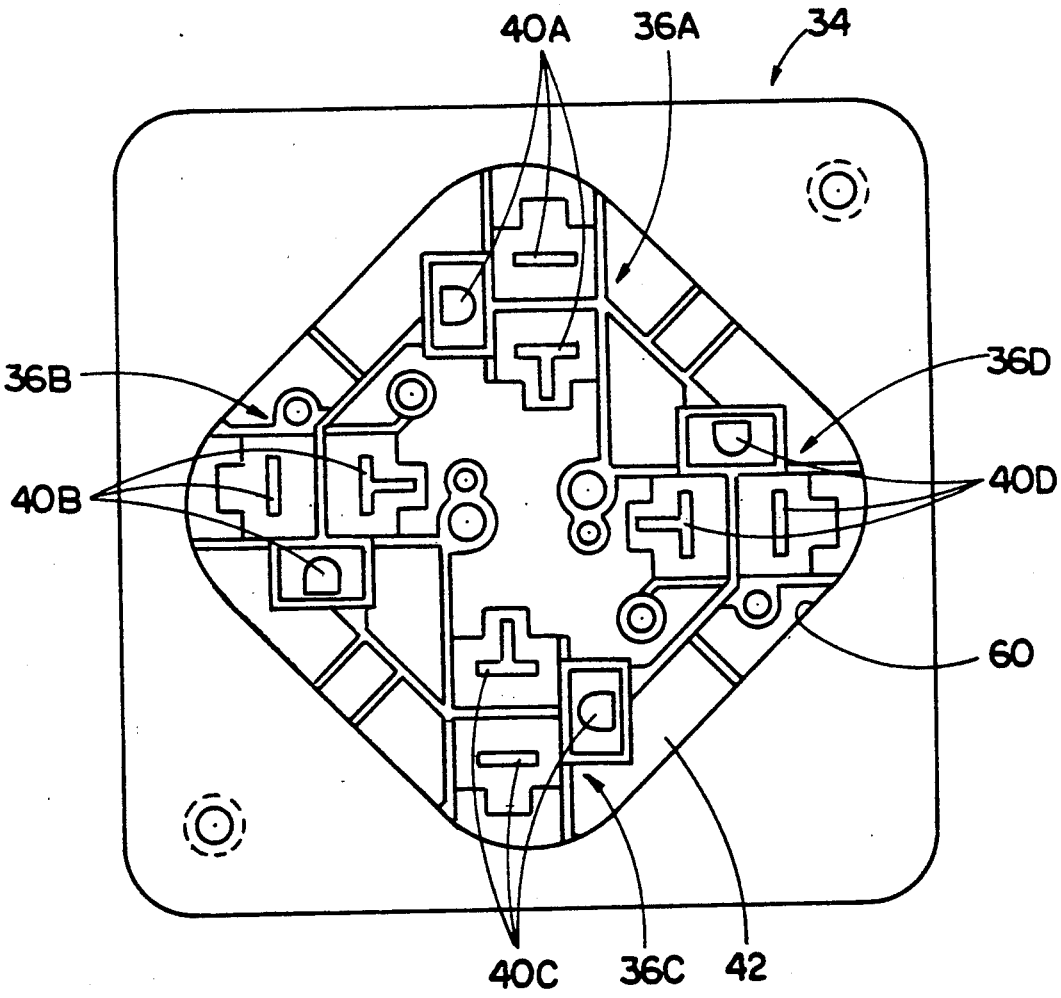
FIG. 4 (PRIOR ART)
FIG. 4 is a rear view of a prior art multiple outlet receptacle with contact supporting conductive plates and a rear closing plate removed.

As shown in FIG. 3, interconnected wall structures 30A, 30B, 30C, 30D are fixed on the rear side of the front face 24 of the housing portion 18 in the four quadrants of the receptacle body 16 for defining physical separation or isolation barriers between the individual blade-receiving apertures of each of the arrays of apertures 26A, 26B, 26C, 26D and the contact elements aligned therewith to be described below. In the locking receptacle 10 of the present invention, the wall structures 30A, 30B, 30C, 30D having respective central cylindrical portions 32A, 32B, 32C, 32D and spoke portions 34A, 34B, 34C, 34D rigidly attached to the central portions 32A, 32B, 32C, 32D and extending radially therefrom. In contrast to the wall structures 30A, 30B, 30C, 30D of the locking receptacle 10 of the present invention, wall structures 36A, 36B, 36C, 36D of the prior art multiple outlet receptacle 38 shown in FIG. 4 are of rectangular tee-shaped configurations. Also, the configurations of the respective blade-receiving apertures 40A, 40B, 40C, 40D through the front face 42 of the prior art receptacle 38 do not permit rotation and thus locking of the plug blades 28 after insertion.

Figure 6:
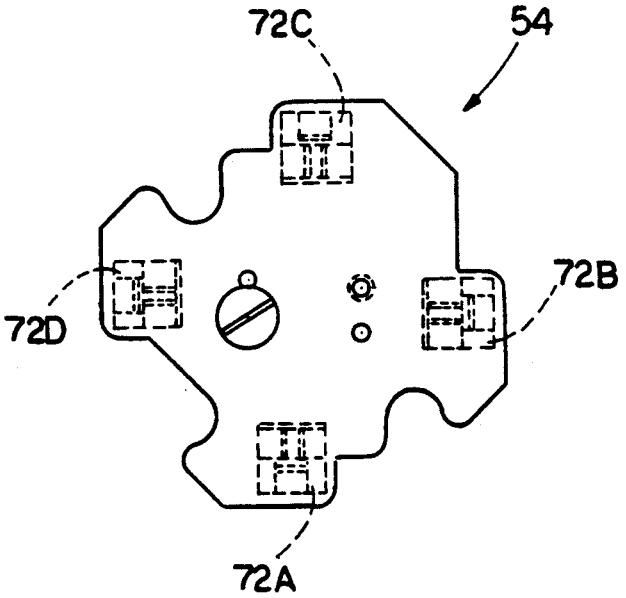
FIG. 6 (PRIOR ART)
FIG. 6 is a rear view of a prior art inner contact-supporting conductive plate for the prior art multiple outlet receptacle of FIG. 4.
Figure 5:
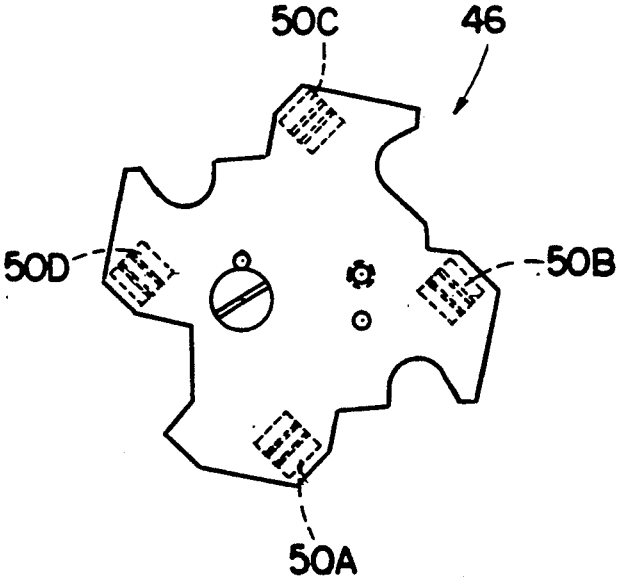
FIG. 5 is rear view of an inner contact-supporting conductive plate for the multiple outlet locking receptacle of FIG. 3.
Figure 7:
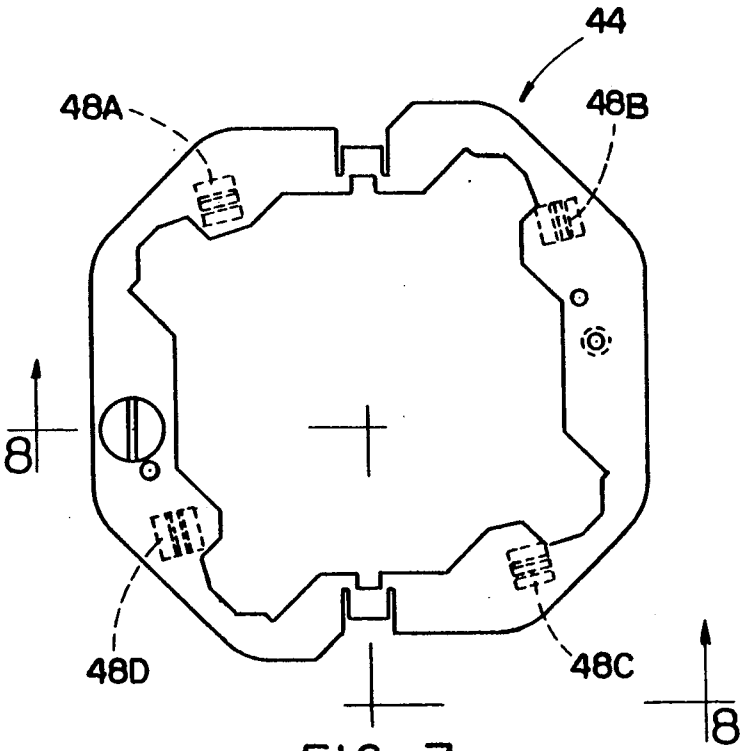
FIG. 7 is a rear view of an outer contact-supporting conductive plate for the multiple outlet locking receptacle of FIG. 3.
Figure 8:
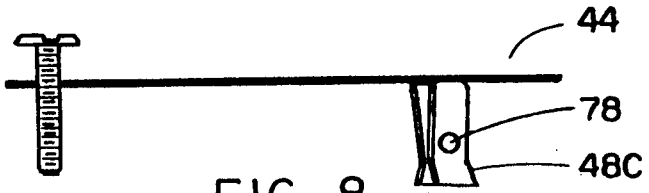
FIG. 8 is a cross-sectional view of the outer plate taken along line 8—8 of FIG. 7.
Figure 9:
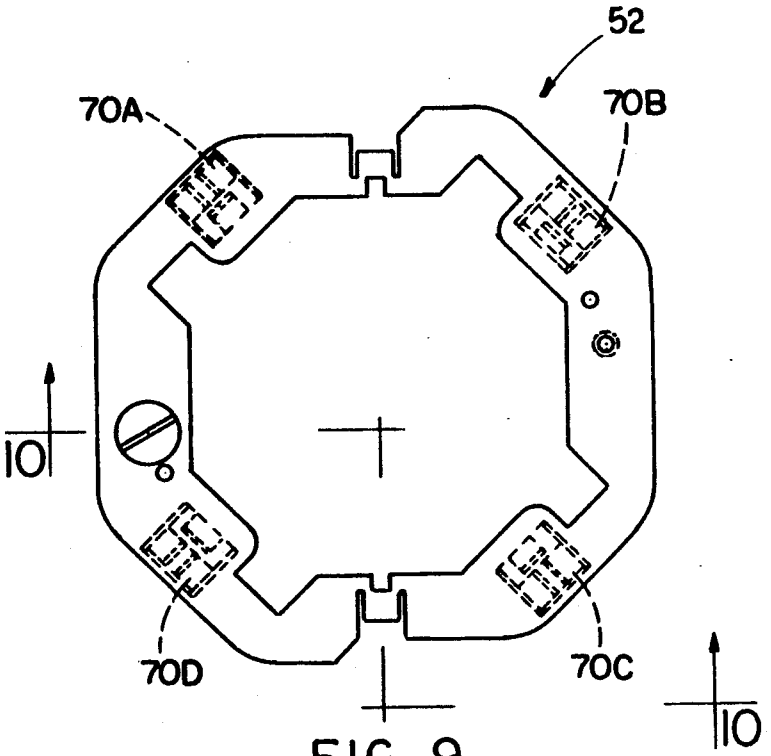
FIG. 9 (PRIOR ART)
FIG. 9 is a rear view of a prior art outer contact-supporting conductive plate for the prior art multiple outlet receptacle of FIG. 4.
Figure 10:
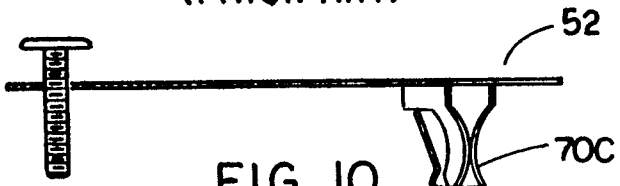
FIG. 10 (PRIOR ART)
FIG. 10 is a cross-sectional view of the prior art outer plate taken along line 10—10 of FIG. 9.
Figure 11:
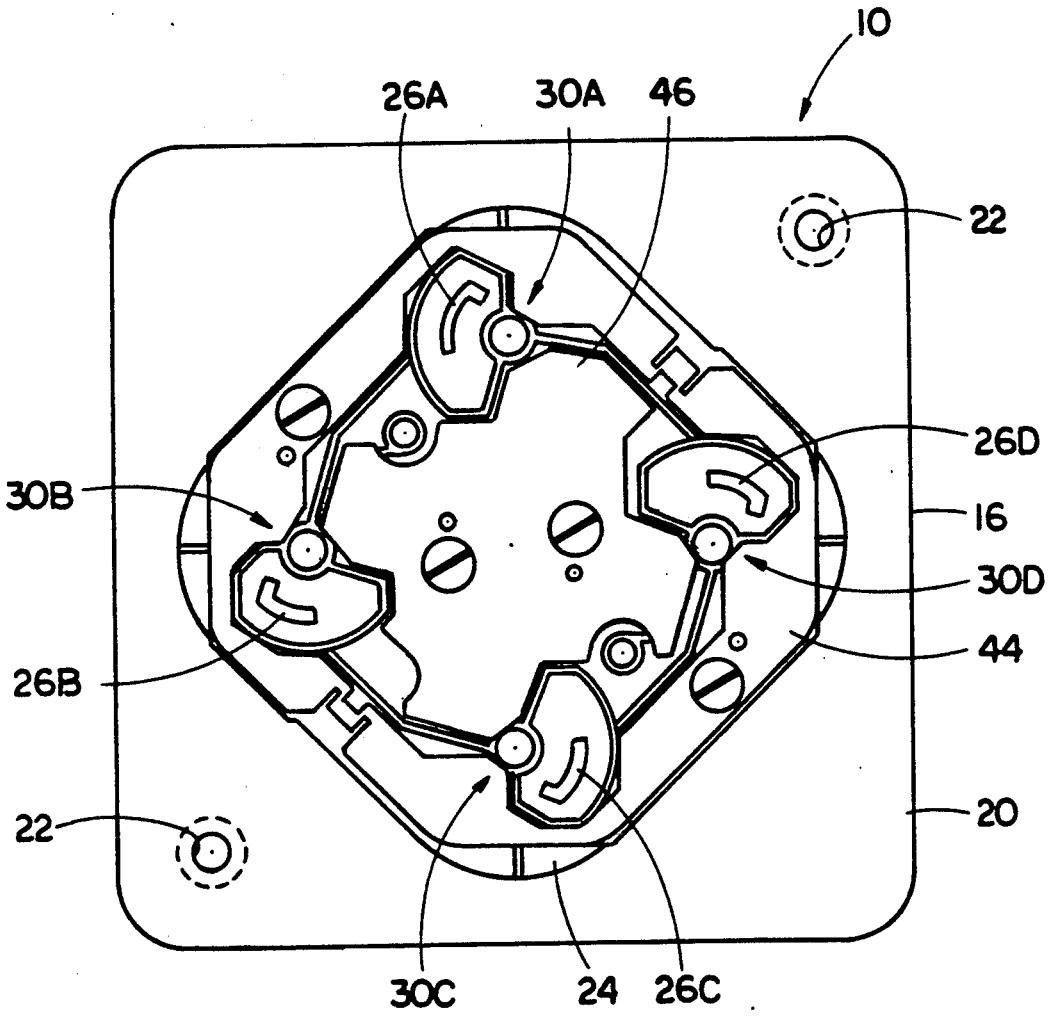
FIG. 11 is a rear view of the multiple outlet locking receptacle of FIG. 3 with the inner and outer contact-supporting conductive plates of FIGS. 5 and 7 applied thereto.

Referring to FIGS. 5, 7 and 8, the multiple outlet locking receptacle 10 also includes first and second conductive plates 44, 46 disposed within the housing portion 18 of the receptacle body 16. The second or outer conductive plate 44 is configured as an annular ring and is located near the periphery of the housing portion 18, while the first or inner conductive plate 46 is configured as an central disk which fits within the outer ring plate 44 and can be made from the same piece of starting material as the first plate 44. The outer and inner plates 44, 46 respectively support first and second groups of internal contact elements 48A, 48B, 48C, 48D and 50A, 50B, 50C, 50D for the corresponding four outlets 12A, 12B, 12C, 12D. The first and second groups of internal contact elements 48A, 48B, 48C, 48D and 50A, 50B, 50C, 50D extend forwardly and are aligned with corresponding arrays of plug blade-receiving apertures 40A, 40B, 40C, 40D defined through the front face 24 of the housing portion 18. The outer and inner conductive plates 44, 46 of the locking receptacle 10 fit respectively outside and inside of the interconnected wall structures 30A, 30B, 30C, 30D as seen in FIG. 11. The outer and inner conductive plates 44, 46 of the locking receptacle 10 of the present invention seen in FIGS. 5, 7 and 8 are substantially similar to the outer and inner conductive plates 52, 54 of the prior art multiple outlet receptacle 38 seen in FIGS. 6, 9 and 10.

Figure 12:
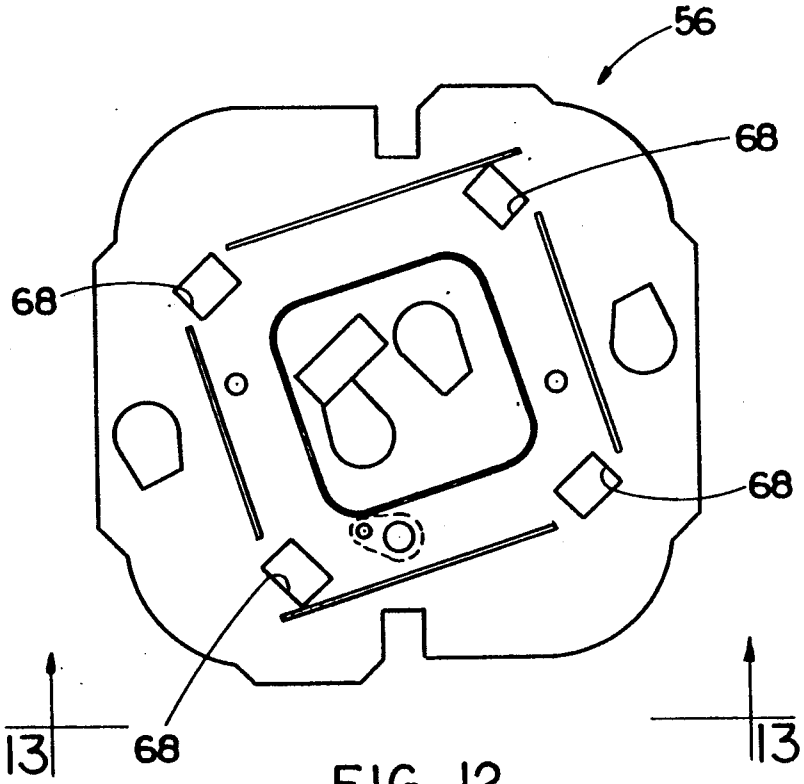
FIG. 12 is a rear view of a rear closing plate for the multiple outlet locking receptacle of FIG. 3.
Figure 13:
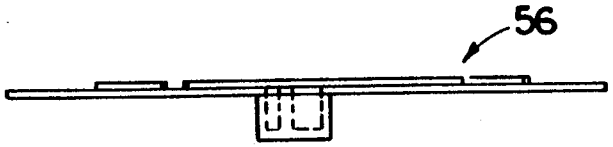
FIG. 13 is a side elevational view of the rear closing plate as seen along line 13—13 of FIG. 12.
Figure 14:
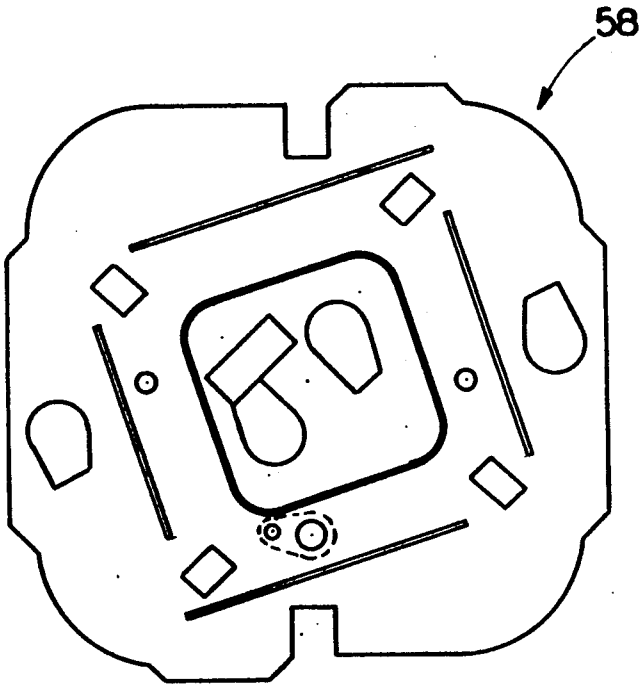
FIG. 14 (PRIOR ART)
FIG. 14 is a rear view of a prior art rear closing plate for the prior art multiple outlet receptacle of FIG. 4.
Figure 15:
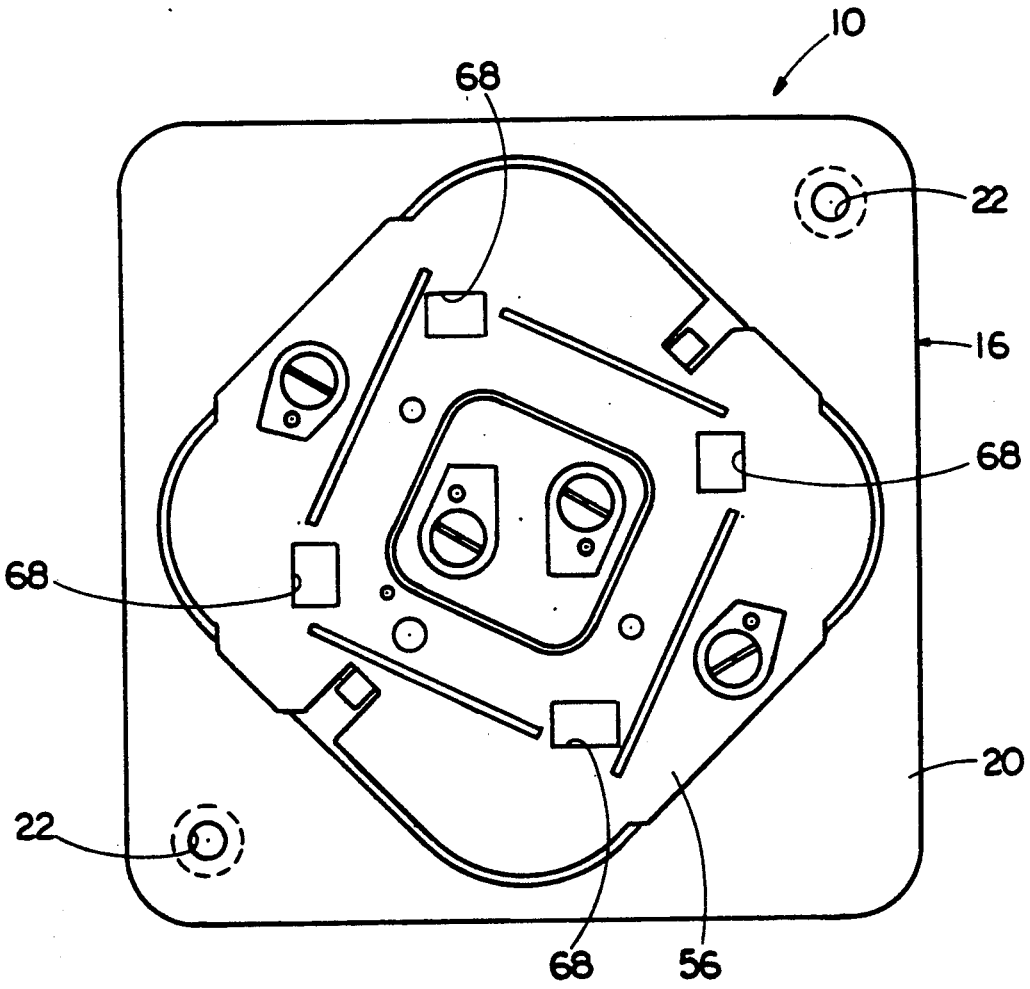
FIG. 15 is a rear view of the multiple outlet locking receptacle of FIG. 3 with the inner and outer contact-supporting conductive plates of FIGS. 5 and 7 and the rear closing plate of FIG. 12 applied thereto.
Figure 16:
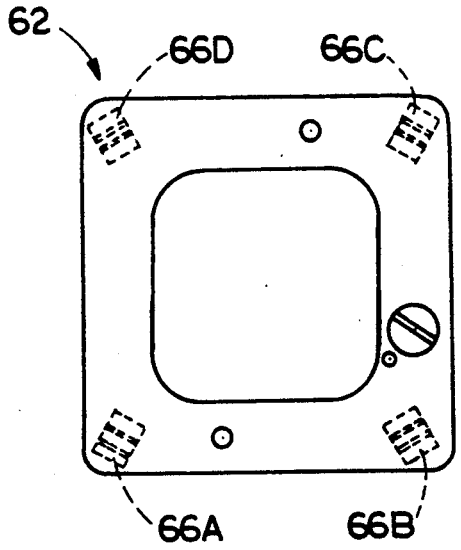
FIG. 16 is a rear view of a contact-supporting ground plate for the multiple outlet locking receptacle of FIG. 3.
Figure 17:
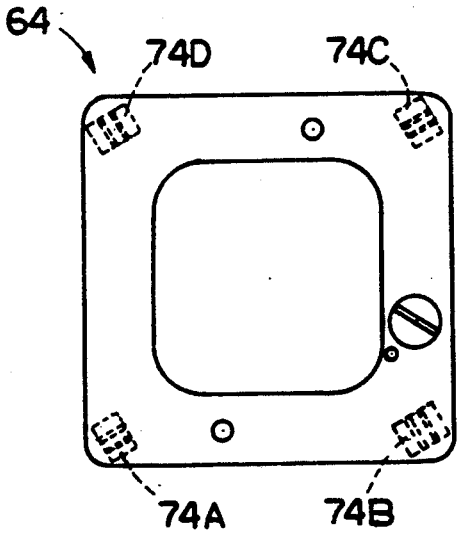
FIG. 17 (PRIOR ART)
FIG. 17 is a rear view of a prior art contact-supporting ground plate for the prior art multiple outlet receptacle of FIG. 4.
Figure 18:
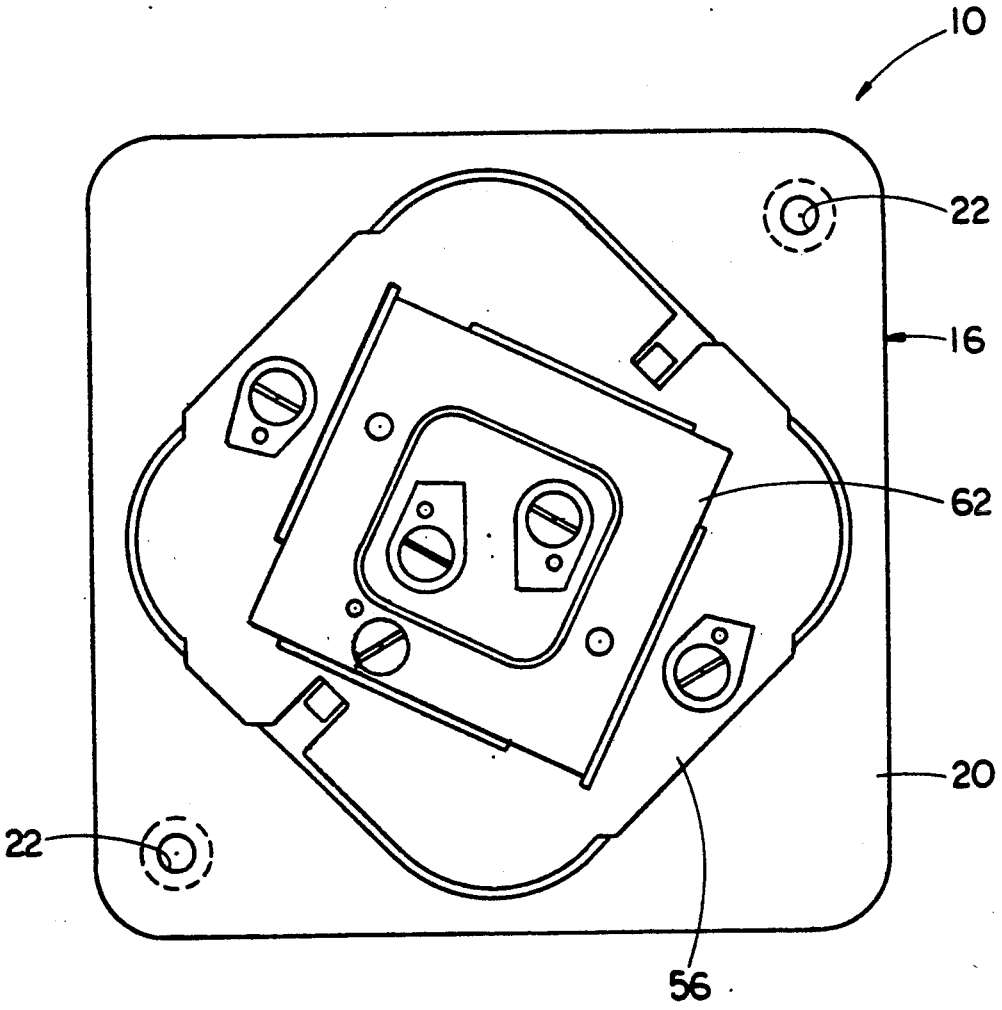
FIG. 18 is a rear view of the multiple outlet locking receptacle of FIG. 3 with the inner and outer contact-supporting conductive plates of FIGS. 5 and 7, the rear closing plate of FIG. 12 and the contact-supporting ground plate of FIG. 16 applied thereto.
Figure 19:
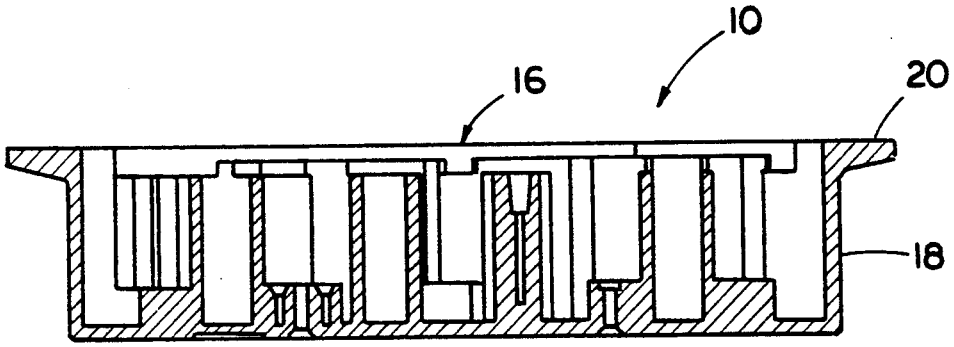
FIG. 19 is a cross-sectional of the multiple outlet locking receptacle taken along line 19—19 of FIG. 3.

Further, both the locking receptacle 10 of the present invention and the prior art receptacle 38 employ respective insulating rear plates 56 and 58 which close the rears of their housing portions 18, 60 and together with the respective wall structures 30A, 30B, 30C, 30D and 36A, 36B, 36C, 36D complete the physical separation and isolation of the first and second groups of contact elements 48A, 48B, 48C, 48D and 50A, 50B, 50C, 50D from each other. The rear closing plate 56 of the locking receptacle 10 seen in FIGS. 12, 13 and 15 is substantially similar to the rear closing plate 58 of the prior art receptacle 38 seen in FIG. 14. The rear closing plate 56 is configured to fit within the back edge of the housing portion 18 substantially flush with the mounting flange portion 20 and provides a substantially planar rear surface for the locking receptacle 10.

Where the locking receptacle 10 and prior art receptacle 38 are grounding-type receptacles, third conductive ground plates 62 and 64 are provided, as illustrated respectively in FIGS. 16 and 17. The respective ground plates 62, 64 are substantially identical and, as seen in the case of the ground plate 62 in FIG. 18, are located on the outside rear surface of the rear closing plate 56. The third conductive ground plate 56 supports a third group of internal contact elements 66 for the corresponding four outlets. The third group of internal contact elements 66 extend through apertures 68 in the rear closing plate 56.

Figure 21:
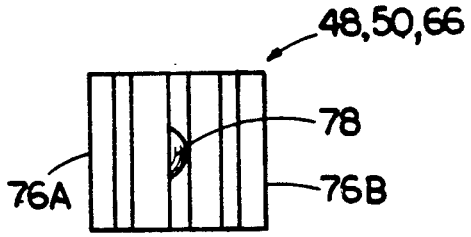
FIG. 21 is an end view of the contact element as seen along line 21—21 of FIG. 20.
Figure 20:
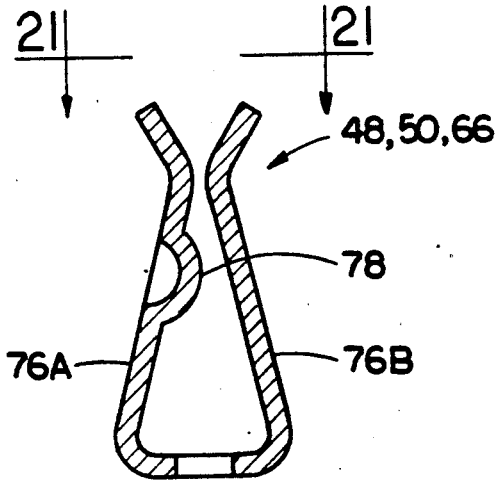
FIG. 20 is a longitudinal sectional view of one of the contact elements of the multiple outlet locking receptacle of FIGS. 1 and 18.

It should be mentioned that the outer, inner and ground plates 52, 54, 64 of the prior art receptacle 38 also mount first, second and third groups of internal contact elements 70A, 70B,70C,70D; 72A,72B,72C,72D; and 74A,74B,74C,74D as seen respectively in FIGS. 6, 8, 9 and 17. However, unlike those of the prior art receptacle 38, the contact elements of the first, second and third groups 48A,48B,48C,48D; 50A,50B,50C,50D; and 66A,66B,66C,66D have a pair of opposite spring legs 76A,76B with a locking protrusion or dimple 78 formed in one leg 76A and projecting toward the other leg 76B, as seen in FIGS. 20 and 21.

Figure 23:
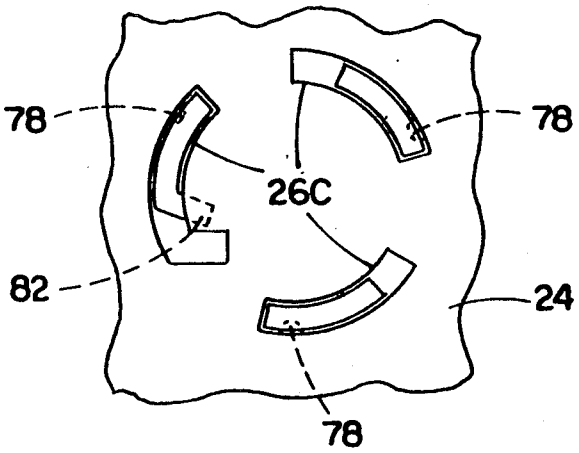
FIGS. 22 and 23 are schematic views of one of four sets of plug blades disposed at respective inserted and locked positions within the internal contact elements associated with one of four sets of arcuate-shaped apertures of the multiple outlet locking receptacle.
Figure 22:
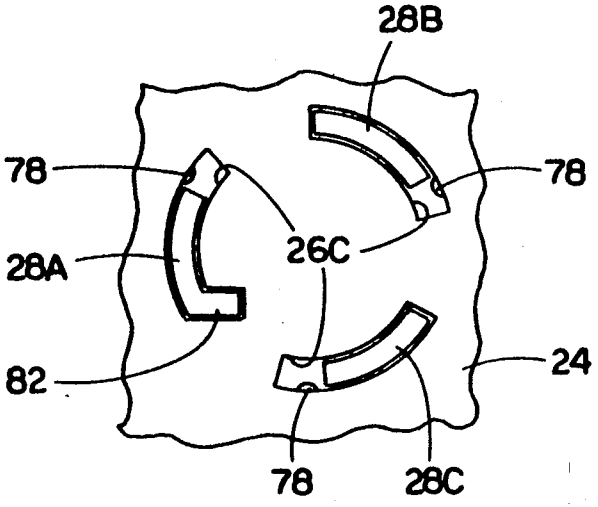
Figure 27:
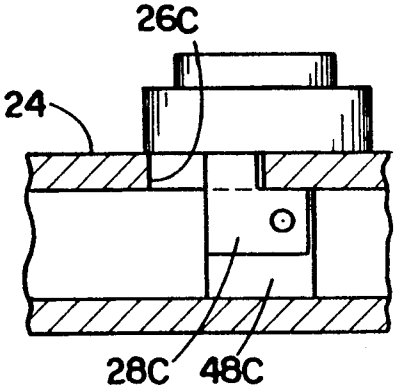
FIGS. 24–27 are a sequence of schematic planar views of a plug blade being installed through one aperture of the multiple outlet locking receptacle and within one internal contact element into successive inserted and locked positions.
Figure 26:
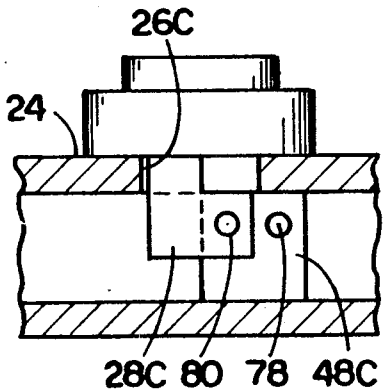
Figure 25:
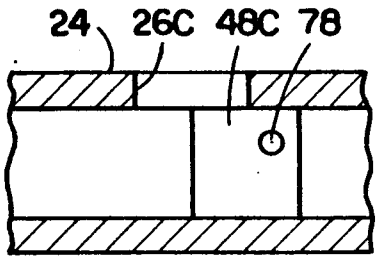
Figure 24:
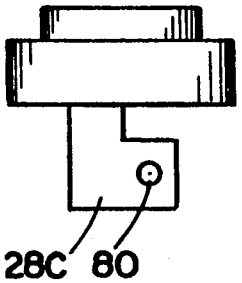

FIGS. 22 and 23 schematically illustrate one of the four sets of plug blades 28A,28B,28C disposed at respective inserted and locked positions within the internal contact elements 48C, 50C,66C associated with one array 26C of four arrays of arcuate-shaped apertures 26A,26B,26C,26D of the locking receptacle. FIGS. 24–27 illustrate a sequence of steps involving the installing of a plug blade 28A through one aperture 26C in the front face 24 of the locking receptacle 10 and within one internal contact element 48C and into a locking relationship with the front face 24. As seen in FIG. 27, each of the plug blades 28A,28B,28C is L-shaped for fitting interfitting in locking relation below the front face 24 and has a hole 80 for receiving the dimple 78 on the one leg 76A. One ground plug blade 28A has an inwardly-protruding flange 82 allows for orientation of the plug blades with the apertures.

It is thought that the present invention and many of its attendant advantages will be understood from the foregoing description and it will be apparent that various changes may be made in the form, construction and arrangement thereof without departing from the spirit and scope of the invention or sacrificing all of its material advantages, the form hereinbefore described being merely a preferred or exemplary embodiment thereof.

We claim:

1. A multiple outlet locking receptacle, comprising:

(a) a molded insulating body including a front housing portion and a rear mounting flange portion integrally formed on and extending radially outward from a rear periphery of said front housing portion, said front housing portion having a front face and four interior wall structures rigidly attached on a reverse side of said front face so as to divide said housing portion into four quadrants;

(b) four arrays of internal contact elements disposed in said housing portion of said body rearwardly of said front face thereof, each of said arrays of internal contact elements being associated with one of said wall structures in one of said quadrants of said housing portion; and (c) means defining a plurality of arrays of plug blade receiving apertures through said front face of said housing portion, each of said arrays of apertures being located in one of said quadrants of said housing portion, aligned with one of said arrays of internal contact elements, and having arcuate configurations for accommodating insertion of the blades of an outlet plug through said array of apertures into electrical contact with said array of internal contact elements and then rotation of the blades relative to said array of internal contact elements into locking relation with at least one of said contact elements of said array and with said housing portion;

(d) said four interior wall structures being rigidly attached on said reverse side of said front face and dividing said housing portion into said four quadrants defining physical separation barriers between individual blade-receiving apertures in each of said arrays of apertures and between individual contact elements in each of said arrays of contact elements aligned therewith, each of said wall structures in each of said quadrants has a central cylindrical portion open at a rear end and closed at a front end by said front face of said front housing and a plurality of spoke portions rigidly attached to said central portion and extending radially therefrom between individual contact elements in each of said arrays of contact elements for providing said physical separation barriers;

(e) said four interior wall structures, said four arrays of internal contact elements, and said four arrays of apertures together defining four electrical outlets located respectively in said four quadrants of said insulated body and being adapted for independently receiving four outlet plugs.

2. The locking receptacle as recited in claim 1, further comprising:

first and second conductive plates disposed within said housing portion and fitted respectively outside and inside of said wall structures and supporting first and second groups of contact elements of said plurality of arrays of contact elements.

3. The locking receptacle as recited in claim 2, wherein said first conductive plate is an outer conductive plate being configured as an annular ring and located near the periphery of said housing portion.

4. The locking receptacle as recited in claim 3, wherein said second conductive plate is an inner conductive plate being configured as a central disk and fitted within said outer ring plate.

5. The locking receptacle as recited in claim 2, further comprising:

an insulating rear plate attached on said housing portion and together with said plurality of wall structures completing physical separation of said first and second groups of contact elements of said plurality of arrays of contact elements from each other.

* * * * *